United States Patent [19]

Dixon

[11] 4,228,841

[45] Oct. 21, 1980

[54] EXTRUDED MATERIAL FOLDING DOOR WITH PANEL LOCK

[75] Inventor: Guy E. Dixon, Miami, Fla.

[73] Assignee: Panelfold Doors, Inc., Miami, Fla.

[21] Appl. No.: 583,525

[22] Filed: Jun. 4, 1975

Related U.S. Application Data

[63] Continuation-in-part of Ser. No. 243,734, Apr. 13, 1972, Pat. No. 3,972,365.

[51] Int. Cl.[2] ..... E05D 15/26

[52] U.S. Cl. ..... 160/183; 160/199; 160/235

[58] Field of Search ..... 160/183, 199, 206, 229, 160/235

[56] References Cited

U.S. PATENT DOCUMENTS

| | | | |
|---|---|---|---|
| 759,447 | 5/1904 | Kinnear | 160/235 |
| 3,056,451 | 10/1962 | Federline et al. | 160/235 X |
| 3,516,473 | 6/1970 | Rosenquist | 160/183 |
| 3,670,797 | 6/1972 | Sassano | 160/183 X |

FOREIGN PATENT DOCUMENTS

| | | | |
|---|---|---|---|
| 1509216 | 3/1969 | Fed. Rep. of Germany | 160/235 |
| 1046391 | 10/1966 | United Kingdom | 160/235 |

*Primary Examiner*—Philip C. Kannan

*Attorney, Agent, or Firm*—Clarence A. O'Brien; Harvey B. Jacobson

[57] ABSTRACT

A folding door or other closure comprising a plurality of panels of extruded material each having a male hinge element along one edge thereof and a female hinge element along the other edge thereof with each panel being of unitary, one-piece construction. The hinge elements are so constructed that interconnection and separation of the panels is attained by longitudinal sliding movement of the male and female hinge elements in relation to each other. A locking means is provided in the form of a projecting means associated with one of the hinge elements which engages with recess means associated with the other hinge element to preclude relative longitudinal movement between adjacent panels while permitting relative pivotal movement between adjacent panels. The locking means includes a structure connected with, mounted on or otherwise associated with the female hinge element so that it is stationary in relation thereto and includes a projection which extends into a recess, groove, slot, or similar structure in the male hinge element. The female hinge element may be of generally channel-shaped configuration and may be constructed of plastic material having sufficient resiliency and flexibility to enable deflection thereof sufficient to enable assembly and disassembly of adjacent panels after the locking means is assembled with the channel-shaped female hinge element.

6 Claims, 12 Drawing Figures

10
12
14
18
20
22
26
28
40
42
46
50

10
12
14
16
18
20
22
24
30
32
34
36
38
40
42
44
46

12
14
18
20
22
24
30
32
36
44
52
54
56
58
62
64
66
68
70

52
54
56
64
66
68

4
4
12
20
26
40
52
54
56
58
60
62
66
70

EXTRUDED MATERIAL FOLDING DOOR WITH PANEL LOCK

CROSS REFERENCE TO RELATED APPLICATION

This application is a continuation-in-part of my copending application Ser. No. 243,734, filed Apr. 13, 1972, for Extruded Plastic Folding Door now U.S. Pat. No. 3,972,365, issued Aug. 3, 1976.

BACKGROUND OF THE INVENTION

1. Field of the Invention

The present invention generally relates to a folding door including a plurality of substantially rigid panels of extruded material with each panel having a female hinge element along one edge thereof and a male hinge element along the other side edge thereof with the hinge elements being continuous throughout the length of the panels and being of unitary construction therewith and more particularly to such a folding door or closure in which a unique locking means is provided to interconnect adjacent panels in a manner to prevent relative longitudinal movement between adjacent panels while permitting relative pivotal movement to enable the panels to fold between extended and collapsed positions.

2. Description of the Prior Art

Folding doors, panels, closures, partitions, or the like, are well known and, in some instances, include hingedly interconnected rigid panels. Prior U.S. Pat. No. 3,486,549, issued Dec. 30, 1969; U.S. Pat. No. 3,516,473, issued June 23, 1970; U.S. Pat. No. 3,670,797, issued June 20, 1972, and U.S. Pat. No. 3,205,935, issued Sept. 14, 1965, are exemplary of prior patents which disclose this type of structure. One of the problems in this type of structure is the hinge connection between adjacent panels. While many hinge connections have been provided between adjacent rigid panels, when extruded panels are used, it is most economical to extrude the male and female hinge elements so that they are formed at the same time as the panel, thus becoming unitary therewith. When the male and female hinge elements are constructed so that interengagement theeof is attained by longitudinal sliding engagement, some arrangement must be provided for preventing relative longitudinal movement after assembly while permitting relative pivotal movement between adjacent panels.

SUMMARY OF THE INVENTION

It is an object of the present invention to provide a folding door incorporating a plurality of substantially rigid panels of extruded material having continuous, pivotal interconnecting hinge elements on the vertical side edges together with a locking means associated with the hinge elements to enable relative pivotal movement between the hinge elements and panels but prevent relative longitudinal movement therebetween during normal opening and closing movement of the door. The locking means is in the form of projecting means mounted on or associated with one of the hinge elements in a stationary relationship and received in a recess means associated with the other hinge element in a fixed relationship so that engagement of the projecting means with the recess means will prevent relative longitudinal movement betweem adjacent panels but permit relative pivotal movement between adjacent panels.

Another object of the invention is to provide a folding door in accordance with the preceding object in which the projecting means is in the form of a locking member which is inserted into the female hinge element and includes a projection thereon engaged with recess means in the male hinge element.

Still another object of the invention is to provide a folding door in accordance with the preceding objects in which the lock member is inserted laterally into the female hinge element into engagement with recess means in the male hinge element by movement through an opening formed in the female hinge element in one embodiment thereof. In another embodiment thereof, the locking member is inserted longitudinally into the female hinge element from one end thereof and includes projections, one of which is received in recess means in the male hinge element and other received in recess means in the interior of the female hinge element, so that the locking member is concealed from view. In another embodiment, a rivet-type lock member is attached to the female hinge element and projects into recess means in the male hinge element.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
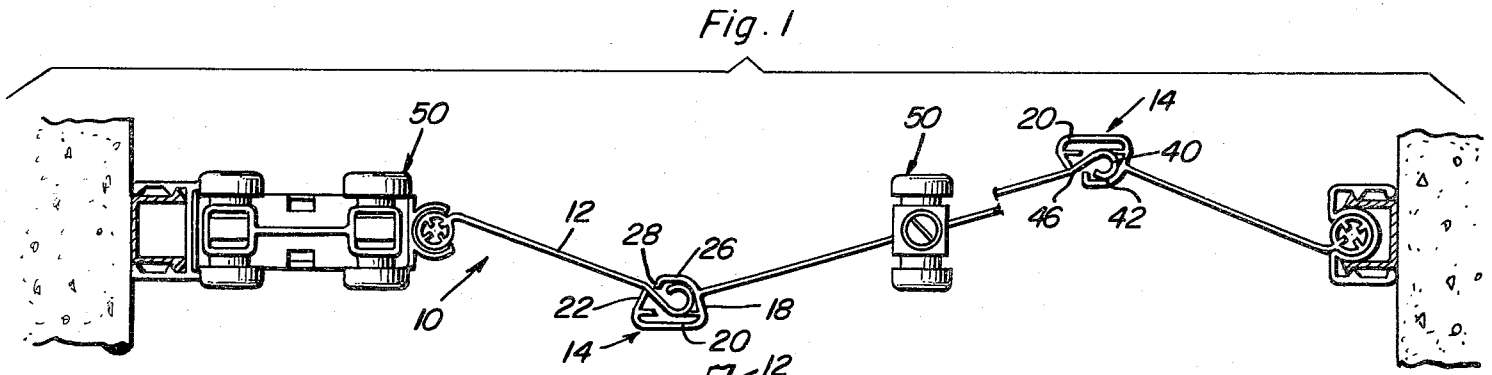
FIG. 1 is a top plan view of a folding door constructed in accordance with this invention illustrating the relationship of the panels and hinge elements when the door is in extended closed position.

Referring now specifically to FIGS. 1–4 of the drawings, the folding door or closure of the present invention is generally designated by reference numeral 10 and includes a plurality of substantially rigid, vertically elongated panels 12 which are constructed of extruded material and are extruded by using conventional extruding techniques. Each of the panels 12 is relatively thin and lightweight and may be constructed from plastic material such as polyvinyl chloride which has some degree of flexibility, resiliency and memory characteristics, with the vertical dimension of each panel being varied depending upon the desired height of the closure door. The width of the panels should, of course, be the same in any door installation and may have a width dimension of approximately five inches. Also, the panels may be extruded from aluminum if desired. The particular structural details of the supporting mechanism for the upper edge of the panels and the door jambs or other structural components defining the vertical side edges of the door opening form no particular part of the present invention, with it being noted that the folding door is provided with an adapter assembly on opposite edges thereof for detachable connecting engagement with the vertical side edge portions of the door opening.

Each of the panels 12 includes a vertically continuous female hinge element 14 on one vertical side edge thereof and a continuous male hinge element 16 on the opposite vertical side edge thereof, with the hinge elements and panels being of unitary, one-piece construction, with the hinge elements being extruded at the same time as the panel, thus enabling economical construction of the panels, with the hinge elements being constructed in a manner to enable the panels to be connected to each other by aligning a male hinge element and a female hinge element in end to end relation and then moving the panels longitudinally in relation to each other, thereby providing sliding interengagement between the female and male hinge elements.

Figure 2:
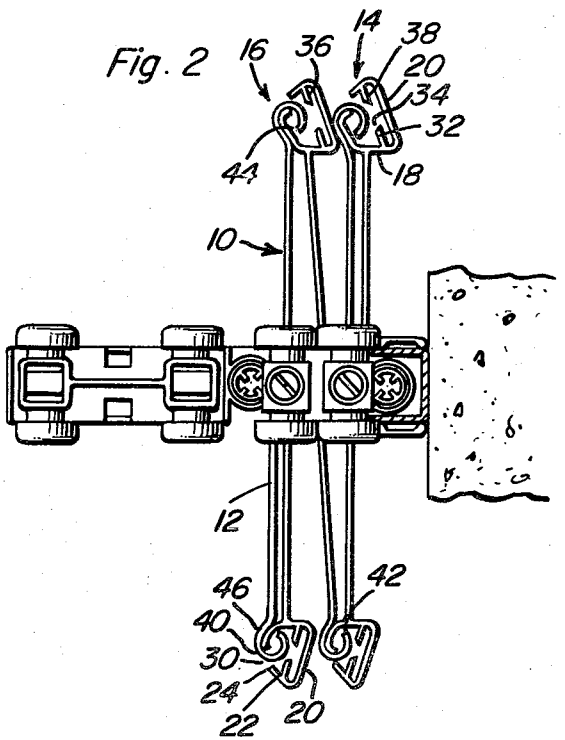
FIG. 2 is a top plan view of the folding door in open position illustrating the orientation of the panels and hinge elements when the panels are in adjacent, generally parallel relation.

The female hinge element 14 is generally of channel-shaped configuration and includes a flange 18 generally perpendicular to the panel 12 although slightly inclined in relation thereto, as illustrated in FIGS. 1 and 2. Extending from one edge of the flange 18 is a flange 20 in acute angular relation to the flange 18 and slightly wider than the flange 18. Connected with the opposite edge of the flange 20 is a flange 22 in acute angular relation to the flange 20 and converging in relation to the flange 18. The flange 22 terminates in a free edge 24 and the edge of the flange 18 opposite from its connection with flange 20 has a flange 26 thereon which is substantially narrower than flange 20 and is disposed generally in opposed relation thereto and also generally parallel thereto although slightly divergent in relation thereto. The flange 26 terminates in an inturned relatively narrow free edge portion 28 which cooperates with the free edge 24 to form an elongated continuous entrance throat or slot 30 for the female hinge element 14.

The female hinge element 14 also includes an inwardly projecting flange 32 on the flange 18 which has a beveled free inner edge 34 and a similar flange 36 is provided on the flange 22 with the inwardly projecting flange 36 also having a beveled free inner edge 38. The flanges 32 and 36 are in alignment with each other and the beveled edges 34 and 38 are spaced from each other and form engagement surfaces for the exterior of the male hinge element during relative pivotal movement of the panels 12 as described hereinafter.

The male hinge element 16 is generally in the form of a cylindrical member 40 formed on the edge of the panel 12 opposite to the female hinge element. The cylindrical member has a free edge 42 thereon which defines an entrance throat or slot 44 between the free edge and the adjacent portion of the panel 12. As illustrated, the cylindrical member 40 is offset slightly from the plane of the panel 12, as indicated at 46, and as illustrated in FIGS. 1 and 2.

When the adjacent panels 12 are assembled, the male and female hinge elements are oriented in aligned end to end relation with the throat or slot 44 receiving the inturned free edge portion 28 and adjacent portion of the flange 26 and the slot or throat 30 receives a portion of the cylindrical member 40 therein so that the major portion of the cylindrical member 40 is received interiorly of the channel-shaped female hinge 14. Relative longitudinal movement of the panels engages the hinge elements and thus pivotally interconnects the panels 12 for relative angular or pivotal movement, with the structure of the hinge elements precluding lateral engagement and disengagement.

As the panels 12 pivot during movement of the folding door between a closed or extended position, as illustrated in FIG. 1, and a collapsed or retracted position, as illustrated in FIG. 2, in which the door is open, the curved external surface of the cylindrical member 40 will engage portions of the internal surface portions of the female hinge element and the flange edges 34 and 38 with the free edge 42 of the cylindrical member 40 pivoting against and moving in relation to the internal surface of the flange 26 and the inturned edge 28 thereon. As the panels 12 reach their fully extended position, the external surface of the male hinge element 16 will be engaged with the inner surface of the flange 26, the beveled edge 34 on the flange 32 and the offset portion 46 of the male hinge element 16 will engage the free edge 24 on the flange 22 and the free edge 38 on the flange 36. When the panels are fully extended, the engagement of the offset portion 46 of the male hinge element with the edge 24 of the flange 22 and the corresponding engagement between the inner surface of the flange 26 and the exterior of the cylindrical member 40 adjacent the throat 44 will form continuous contact between adjacent panels 12 thereby providing a continuous barrier to passage of light, noise, sound, air, and the like, in order to provide a closure for the door opening. As soon as the panels move toward an open position, the dimensions of the male hinge element 16 are such that some degree of relative lateral movement is permitted which eliminates frictional binding of the hinge assembly. Moreover, the reduced surface area of contact as defined by the edges of the flanges 32 and 36 substantially reduce the friction between the male hinge element and the female hinge element thereby minimizing frictional resistance to movement of the folding doors between open and closed positions.

The folding door 10 may be supported in any suitable manner, such as by roller-type carriages 50 engageable with an overhead track (not shown). The previously disclosed structure is the same as that disclosed in my prior copending application which is incorporated herein by reference thereto. Inasmuch as certain of the panels 12 may not be supported, a panel locking device is provided for preventing relative vertical movement between adjacent panels 12 while permitting relative pivotal movement therebetween, so that adjacent panels 12 cannot move vertically in relation to each other.

Figure 4:
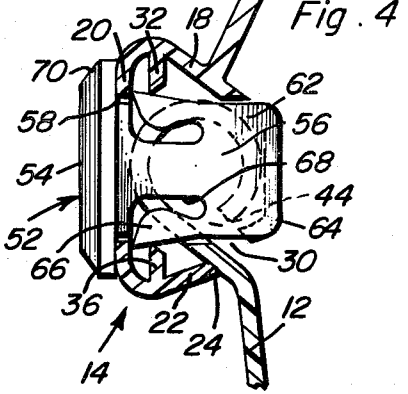
FIG. 4 is a transverse sectional view taken along section line 4—4 of FIG. 3.
Figure 5:
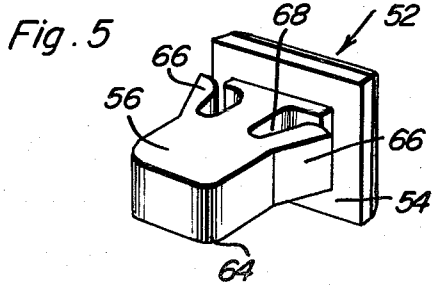
FIG. 5 is a perspective view of the locking member.
Figure 3:
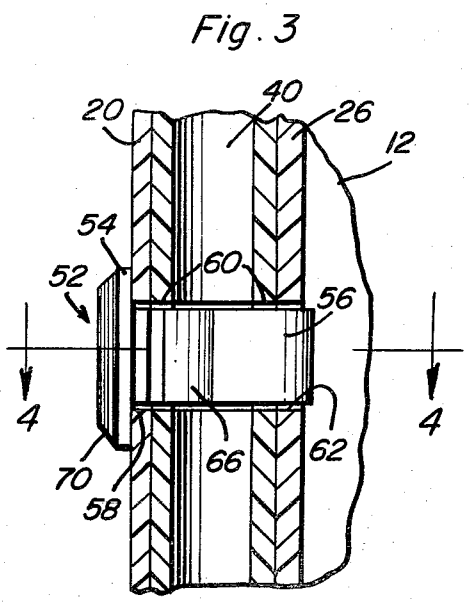
FIG. 3 is a vertical sectional view, on an enlarged scale, through the hinge elements and illustrating one embodiment of the locking member associated therewith.

In the embodiment illustrated in FIGS. 3–5, the lock device 52 includes a generally square, rectangular, round or oval plate 54 which is in the form of a mounting plate having a projecting means 56 on one surface thereof which is in the form of a tongue or lug. The flange 20 of the female hinge element 14 is provided with an opening 58 therethrough which receives the projecting means 56 and the male hinge element 16 includes a corresponding opening or slot 60 extending completely therethrough, that is, through peripheral portions of the cylindrical member 40. The female hinge element 14 likewise is provided with a slot-like opening 62 in the flange 26 and the free edge 28 thereof so that when the openings 58, 60 and 62 are in alignment, the projecting means 56 may extend completely therethrough with the end of the lug or tongue 56 opposite from the mounting plate 54 being rounded and curved as at 64 to conform generally with the external surface of the flange 26 and adjacent portion of the free edge 28 so that the projecting means 56 does not project inwardly beyond the surface of the flange 26 but forms supporting engagement with the flange 26 and the flange 20 as well as both sides of the cylindrical member 40.

The projecting means 56 is provided with outwardly flared and inclined locking tines or tabs 66 which are disposed adjacent the surface of the plate 54 and in opposed relation thereto with the locking tines 66 being outwardly flared and having a substantial degree of flexibility because of an inwardly extending slot 68 which separates a substantial portion of the locking tines 66 from the lug or tongue 56 as illustrated in FIGS. 4 and 5. The distance between the free edge of the locking tines 66 and the plate 54 is just slightly more than the thickness of the flange 20 and the lateral distance between the remote free edges of the opposed locking tines 66 is slightly greater than the lateral dimension of the opening 58 so that the projecting means 56 may be pushed inwardly through the opening 58 until the plate 54 engages the outer surface of the flange 20 at which time the tines 66 will be slightly beyond the inner surface of the flange 20 and will return to a normal position which is slightly greater than the width of the opening 58 thereby locking the lock member 52 to the flange 20 with this orientation being best illustrated in FIG. 4. The outer surface of the plate 54 may be beveled or rounded as at 70 and the locking member may have a color similar to the adjacent panels and flanges so that it will hardly be discernible.

The locking member 52 when inserted through the female and the male hinge elements 14 and 16 will retain the panels 12 in assembled condition, prevent relative longitudinal movement therebetween and permit relative pivotal movement therebetween. The locking member 52 is constructed of resilient material such as plastic and the lug 56 extending through both sides of the female hinge element will provide effective supporting contact with the female hinge element at two spaced points. Additionally, the construction of the female hinge element from plastic material having resilient, flexible and memory characteristics enables deflection of the female hinge element, particularly the flanges 20 and 22 sufficiently to withdraw the tongue or lug 56 from the opposite flange 26 and from the male hinge element to enable disassembly of adjacent panels when the locking member 52 is assembled with the female hinge element 14 and, of course, the panels may be reassembled with the locking member in place by deflection of the female hinge element, particularly flanges 20 and 22 thereby enabling assembly of the locking member with the female hinge element prior to assembly of the male hinge element with the female hinge element or enabling the locking member to be inserted after assembly of the male hinge element with the female hinge element and, of course, enabling assembly and disassembly of the adjacent panels at any time without rupture or damage to the female hinge element.

Figure 6:
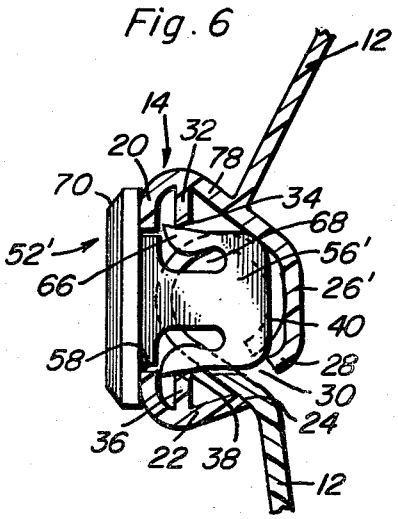
FIG. 6 is a sectional view similar to FIG. 3 illustrating another embodiment of locking member.

FIG. 6 illustrates a cantilevered embodiment of the locking member 52' which is the same as that illustrated in FIGS. 3–5 except that the tongue or lug 56' is shorter than lug 56 and does not extend through the flange 26' which, in this embodiment, is imperforate. All of the other structural features are the same as illustrated in FIGS. 3–5 with the same reference numerals being used. In this arrangement, the locking member is cantilevered from flange 20 thus leaving the flange 26 uninterrupted and supporting the lug 56' solely from flange 20 of the female hinge element.

Figure 8:
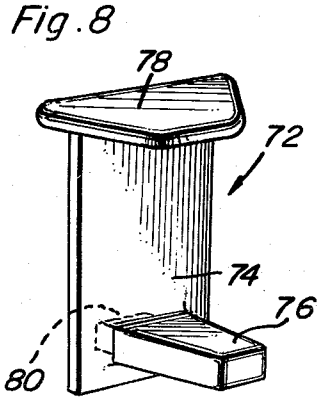
FIG. 8 is a perspective view of a longitudinally inserted embodiment of the locking member.
Figure 7:
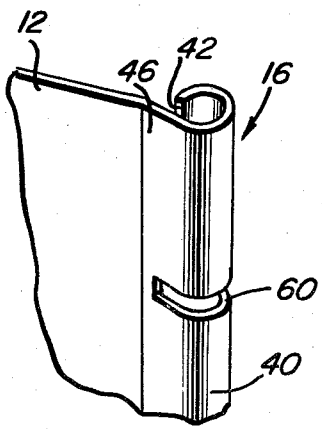
FIG. 7 is a perspective view of a portion of the male hinge element illustrating the slot therein.
Figure 9:
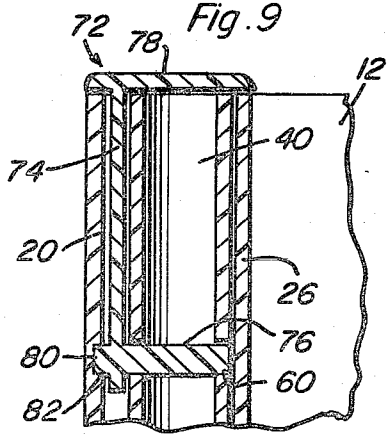
FIG. 9 is a vertical sectional view of the hinge elements and the locking member of FIG. 8.

FIGS. 8 and 9 illustrate an embodiment of the locking member generally designated by the numeral 72 which is inserted inwardly from an end of the adjacent panels 12 and includes a plate 74 of a width and thickness to be received inwardly of the flange 20 and between the flange 20 and the flanges 32 and 36. One surface of the plate 74 is provided with a projecting means 76 in the form of a tongue which is engaged in the slot or recess means 60 in the cylindrical member 40 of the male hinge element 16. The upper end of the plate 74 is provided with a top plate 78 which overlies and forms a closure for the upper end of the female hinge element and may engage the male hinge element. The opposite side of the plate 74 is provided with a projecting means in the form of a lug 80 received in a recess 82 in the form of a groove in the inner surface of the flange 20 or a slot through the flange 20 so that the lug 80 received in the recess or groove 82 will securely lock the mounting plate 74 to the female hinge element 14 and the projecting means 76 will engage the male hinge element 16 by positioning through the slot 60. The female hinge element may be deflected sufficiently to enable disengagement of the locking projecting means 76 from the recess means 60 to enable assembly and disassembly of the adjacent panels 12 with the projecting means 76 having sufficient rigidity to maintain the adjacent panels 12 in predetermined longitudinal relation and thereby prevent relative longitudinal movement while permitting relative angular or pivotal movement. The locking member 72 may also be constructed of plastic material. In this construction, the locking member 72 may be optionally secured to the female hinge element by suitable adhesive, as desired, although the flanges 32 and 34 combined with the flange 20 and the structure of the projecting lug 80 and groove 82 will securely retain the locking member 72 in place.

Figure 11:
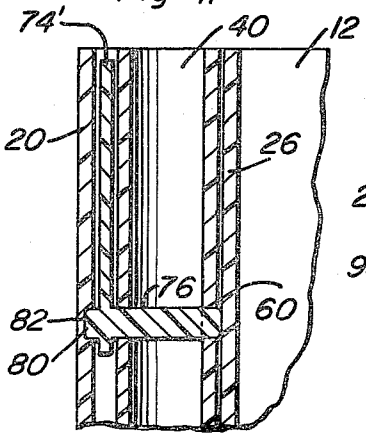
FIG. 11 is a vertical sectional view of the hinge elements and the locking member of FIG. 10.
Figure 10:
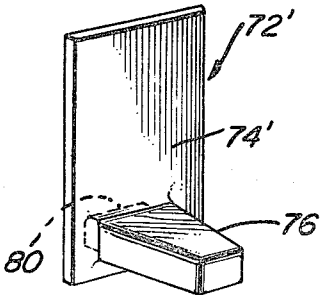
FIG. 10 is a perspective view of an embodiment of the locking member similar to FIG. 8 but without a top plate.

FIGS. 10 and 11 illustrate another embodiment of longitudinally inserted locking member 72' which is the same as that illustrated in FIGS. 8 and 9 except that the top plate has been omitted. Identical reference numerals are used to designate components in FIGS. 10 and 11 which are the same as in FIGS. 8 and 9. In this arrangement, the locking member 72' is completely concealed.

Figure 12:
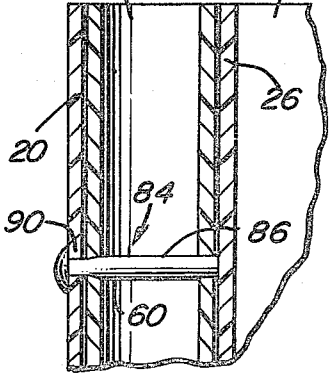
FIG. 12 is a vertical sectional view of the hinge elements and a locking member in the form of a rivet.

FIG. 12 illustrates another embodiment of the locking device generally designated by numeral 84 which includes a rivet structure 86 mounted on and extending inwardly from the flange 20 of the female hinge element 14. The rivet 86 provides a projecting means which is received in the recess means or slot 60 in the cylindrical member 40 of the male hinge element thus also serving to prevent relative longitudinal movement of adjacent panels while permitting relative pivotal movement during normal operation of the folding door. The female hinge element may be deflected sufficiently for assembly and disassembly of the adjacent panels and the rivet structure may be any suitable metal or plastic rivet but preferably is of the "pop" rivet construction or blind rivet constructuction which may be inserted in an appropriate opening 90 in the flange 20 from the exterior thereof and anchored in place employing a conventional tool provided for this purpose which is a conventional manner of assembling this type of rivet with a panel structure.

The locking devices illustrated in FIGS. 6–12 include only a single or cantilevered supporting engagement with the male hinge element. However, if desired, a dual point of support may be provided with the female hinge element by extending the locking member through an appropriate opening formed in flange 26. In each embodiment of the invention, the female hinge element or hinge member is provided with a projecting means which is stationary in relation thereto with the projecting means received in recess means in or on the male hinge element to enable pivotal movement of the panels and preclude relative longitudinal movement therebetween except when it may be desired to disassemble or assemble the panels with the locking member mounted on the female hinge element. In this event, the female hinge element may be deflected by exerting lateral pressure, such as thumb pressure, on the free edge portion of the flange 22 adjacent the locking member to move the flange 22 and flange 20 laterally sufficiently to disengage the locking member from the recess means 60 thus enabling longitudinal sliding movement of the hinge elements with the inner end of the locking member engaging the external surface of the male hinge element during such longitudinal movement. The locking means illustrated in FIGS. 3–7 and 10–12 may be utilized at any point along the length of the panels and preferably at the center thereof while the locking means illustrated in FIGS. 8 and 9 is located adjacent one end of the panels, preferably the upper end of the panels.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A folding closure comprising a plurality of elongated vertical panels, hinge means connecting the vertical side edges of adjacent panels together to enable relative pivotal movement of the adjacent panels for extending and retracting the closure during movement between closed and open positions, each hinge means comprising a continuous male hinge element on one side edge of each panel and a continuous female hinge element on the other side edge of each panel, said male and female hinge elements being interengaged by relative end to end longitudinal movement between adjacent panels, and means associated with said hinge elements to preclude relative longitudinal movement between adjacent panels while permitting relative pivotal movement therebetween, said means including projecting means stationary with respect to one of the hinge elements and engaged with recess means in the other hinge element to prevent relative longitudinal movement between the hinge elements, said projecting means and recess means being spaced longitudinally inwardly from the ends of the hinge elements, said female hinge element being of generally channel-shaped configuration and said male hinge element being of generally cylindrical configuration with each of the hinge elements including a longitudinally continuous throat arranged so that when the entrance throats are registered in end to end relation, the hinge elements are interconnected by longitudinal movement of the panels to a position alongside of each other with the entrance throats being such as to prevent lateral disengagement of the hinge elements, said channel-shaped hinge element having said projecting means stationary with respect thereto and said cylindrical hinge element having said recess means therein receiving the projecting means, said means associated with said hinge element being in the form of a locking member, said locking member being stationarily engaged with the channel-shaped hinge element and including a projecting means interiorly thereof engaged with the recess means in the cylindrical hinge element, said channel-shaped hinge element including an opening through the bight portion thereof, said locking member including a plate engaging the exterior of the bight portion and said projecting means including a lug projecting from the plate, said lug extending through the opening in the bight portion of the channel-shaped hinge element and engaged in said recess means, said recess means being in the form of a slot through the generally cylindrical male hinge element, said channel-shaped hinge element including a flange opposite to and generally paralleling the bight portion with said flange being imperforate, said lug extending completely through the slot and terminating in a flat end surface adjacent the flange thereby being cantilever supported solely from the bight portion of the channel-shaped hinge element.

2. The structure as defined in claim 1 wherein said lug includes resilient lock tines on opposite sides thereof to engage the inner surface of the bight portion adjacent the opening to lock the locking member to the channel-shaped hinge element.

3. A folding closure comprising a plurality of elongated vertical panels, hinge means connecting the vertical side edges of adjacent panels together to enable relative pivotal movement of the adjacent panels for extending and retracting the closure during movement between closed and open positions, each hinge means comprising a continuous male hinge element on one side edge of each panel and a continuous female hinge element on the other side edge of each panel, said male and female hinge elements being interengaged by relative end to end longitudinal movement between adjacent panels, and means associated with said hinge elements to preclude relative longitudinal movement between adjacent panels while permitting relative pivotal movement therebetween, said means including projecting means stationary with respect to one of the hinge elements and engaged with recess means in the other hinge element to prevent relative longitudinal movement between the hinge elements, said projecting means and recess means being spaced longitudinally inwardly from the ends of the hinge elements, said female hinge element being of generally channel-shaped configuration and said male hinge element being of generally cylindrical configuration with each of the hinge elements including a longitudinally continuous throat arranged so that when the entrance throats are registered in end to end relation, the hinge elements are interconnected by longitudinal movement of the panels to a position alongside of each other with the entrance throats being such as to prevent lateral disengagement of the hinge elements, said channel-shaped hinge element having said projecting means stationary with respect thereto and said cylindrical hinge element having said recess means therein receiving the projecting means, said means associated with said hinge element being in the form of a locking member, said locking member being stationarily engaged with the channel-shaped hinge element and including a projecting means interiorly thereof engaged with the recess means in the cylindrical hinge element, said channel-shaped hinge element including an opening through the bight portion thereof, said locking member including a plate engaging the exterior of the bight portion and said projecting means including a lug projecting from the plate, said lug extending through the opening in the bight portion of the channel-shaped hinge element and engaged in said recess means, said recess means being in the form of a slot through the generally cylindrical male hinge element, said channel-shaped hinge element including a flange opposite to and generally paralleling the bight portion with said flange having an opening therethrough, said lug being received in the opening in said bight portion, extending through the slot and through the opening in said opposite flange whereby the lug is supported from the channel-shaped hinge element at two spaced points, said lug terminating in a flat end surface adjacent to and generally paralleling the outer surface of the flange.

4. The folding closure as defined in claim 3 wherein said lug includes resilient lock tines on opposite sides thereof to engage the inner surface of the bight portion adjacent the opening to lock the locking member to the channel-shaped hinge element.

5. The folding closure as defined in claim 3 wherein said lug includes resilient lock tines on opposite sides thereof, said tines including free ends spaced from and in opposing relation to the plate, the free ends of the tines being resilient for inward deflection when passing through the opening in the bight portion and returning to an extended position for engagement with the inner surface of the bight portion adjacent opposite edges of the opening for retaining the plate adjacent the outer surface of the bight portion of the channel-shaped hinge element, said channel-shaped member including inwardly extending flanges opposite to the entrance throat for engaging the external periphery of the generally cylindrical male hinge element during pivotal movement of the panels.

6. The folding closure as defined in claim 3 wherein said channel-shaped hinge element is constructed of substantially rigid material having sufficient resiliency and flexibility to enable the bight portion and lug mounted thereon to be deflected away from the cylindrical hinge element sufficient to disengage the lug from the opening in the opposite flange and the slot so that the panels may be moved longitudinally in relation to each other with the flat terminal end surface sliding along the external surface of the cylindrical hinge element.

* * * * *